US006103100A

United States Patent [19]

Hart

[11] Patent Number: 6,103,100

[45] Date of Patent: Aug. 15, 2000

[54] METHODS FOR INHIBITING CORROSION

[75] Inventor: Paul R. Hart, The Woodlands, Tex.

[73] Assignee: BetzDearborn Inc., Trevose, Pa.

[21] Appl. No.: 09/108,912

[22] Filed: Jul. 1, 1998

[51] Int. Cl.[7] ..... C10G 19/00

[52] U.S. Cl. ..... 208/47; 208/48 AA; 208/252

[58] Field of Search ..... 208/47, 48 AA, 208/252

[56] References Cited

U.S. PATENT DOCUMENTS

| | | | |
|---|---|---|---|
| 1,829,705 | 10/1931 | Walker et al. | 507/263 |
| 1,844,475 | 2/1932 | Morrell et al. | 208/47 |
| 2,320,267 | 5/1943 | Cohen | 208/12 |
| 2,557,081 | 6/1951 | De Groote et al. | 252/331 |
| 3,819,328 | 6/1974 | Go | 21/2.5 R |
| 3,974,220 | 8/1976 | Heib et al. | 260/569.6 P |
| 4,199,440 | 4/1980 | Verachtert | 208/230 |
| 4,271,054 | 6/1981 | Kim | 260/29.3 |
| 4,300,995 | 11/1981 | Liotta | 208/8 |
| 4,416,796 | 11/1983 | Böhm et al. | 252/338 |
| 4,600,518 | 7/1986 | Ries et al. | 252/34 |
| 4,895,641 | 1/1990 | Briceno et al. | 208/286 |
| 4,992,164 | 2/1991 | McCullough et al. | 208/282 |
| 4,992,210 | 2/1991 | Naeger et al. | 252/389.62 |
| 5,080,779 | 1/1992 | Awbrey et al. | 208/252 |
| 5,114,566 | 5/1992 | Naeger et al. | 208/289 |
| 5,194,143 | 3/1993 | Roling | 208/291 |
| 5,264,114 | 11/1993 | Dunbar | 208/48 AA |
| 5,421,993 | 6/1995 | Hille et al. | 208/47 |
| 5,626,742 | 5/1997 | Brons et al. | 208/235 |
| 5,660,717 | 8/1997 | Lindemuth | 208/251 R |
| 5,683,626 | 11/1997 | Sartori et al. | 252/389.62 |
| 5,688,479 | 11/1997 | Chao | 423/240 S |

FOREIGN PATENT DOCUMENTS

| | | |
|---|---|---|
| WO 97/08270 | 3/1997 | WIPO . |
| WO 97/08271 | 3/1997 | WIPO . |
| WO 97/08275 | 3/1997 | WIPO . |

*Primary Examiner*—Walter D. Griffin
*Assistant Examiner*—Nadine Preisch
*Attorney, Agent, or Firm*—Greenblum & Bernstein, P.L.C.

[57] ABSTRACT

Disclosed are methods and compositions for inhibiting corrosion in the overhead of a crude unit distillation tower by washing the crude oil with water containing a hydrophilic, polymeric, nitrogenous base, a di- or multivalent metallic base, or a combination of a multi-polyether-headed surfactant and a monovalent metallic base. In another embodiment, a hydrophobic, nitrogenous base is added directly to the crude oil then washed with water.

31 Claims, No Drawings

METHODS FOR INHIBITING CORROSION

FIELD OF THE INVENTION

The present invention relates to methods and compositions for reducing the level of acids in the overhead of a refinery crude oil atmospheric distillation tower.

BACKGROUND OF THE INVENTION

Crude petroleum oil charged to a petroleum refinery contains a number of impurities harmful to the efficient operation of the refinery and detrimental to the quality of the final petroleum product.

Oil insoluble mineral salts, such as the chlorides, sulfates and nitrates of sodium, potassium, magnesium, calcium, and iron are present, generally in the range of 3 to 200 pounds per thousand barrels (ptb) of crude (calculated, by convention, as NaCl). The mineral salts of the less alkaline metals, such as magnesium, calcium, and iron, are acidic. Oil insoluble solids, such as the oxides and sulfides of iron, aluminum, and silicon are also present. Oil soluble or colloidal metal soaps of sodium, potassium, magnesium, calcium, aluminum, copper, iron, nickel, and zinc, and oil soluble organometallic chelants, such as porphyrins of nickel and vanadium, may be found in various concentrations. These metal species contribute to corrosion, heat exchanger fouling, furnace coking, catalyst poisoning, and end product degradation and devaluation.

In addition, oil soluble or colloidal acidic species, such as the hydrochloride salts of sufficiently hydrocarbonaceous basic nitrogen compounds (e.g., amines), organic sulfoxy, phenolic, and carboxylic acids, such as naphthenic acids ($C_nH_{2n}O_2$), are present to varying degrees in petroleum crude. These acids also contribute to various corrosion problems.

The primary corrodent of the main fractionator unit atmospheric distillation tower overhead and other regions of the refinery system where temperatures are elevated and water condenses, is hydrochloric acid (HCl). This gas is produced at the high temperatures in the bottom of the distillation tower, primarily via three reactions:

1. Hydrolysis of Mg $Cl_2.2H_2O$ and $CaCl_2.2H_2O$
2. Metathesis of NaCl and organic acids
3. Pyrolysis of amine hydrochloride salts The evolution of HCl is reduced primarily by washing the water soluble precursors, such as $MgCl_2$, $CaCl_2$, NaCl and the smaller, more hydrophilic organic acids and amines, including ammonia, from the raw crude oil in a single or multi-stage desalter. Other halide salts such as those of bromide and fluoride which have been found to also cause corrosion can also be reduced in this manner.

Crude oil desalting is a common crude oil purification method where an emulsion is formed by adding water in the amount of approximately 2.5% to 10% by volume of the crude oil at temperatures from about 150° F. to 300° F. The added water is intimately mixed into the crude oil to contact the impurities therein in order to transfer these impurities into the water phase of the emulsion. The emulsion's intimacy and subsequent resolution is usually effected with the assistance of emulsion making and breaking surfactants, and by the known method of providing an electrical field to polarize the water droplets. As the emulsion is broken, the water phase and petroleum phase are separated and subsequently removed from the desalter vessel. The petroleum phase is next directed to the distillation train where it is fractionated for further processing downstream. The effluent brine, the pH of which is kept between 5 and 9, typically 6 and 8, is sent to the wastewater treatment unit.

Some of the impurities attempted to be removed by this method remain with the petroleum and ultimately result in the corrosion and fouling problems previously described. Various concepts which have attempted to resolve these continuing problems are described hereinbelow.

SUMMARY OF THE INVENTION

The present invention relates to methods and compositions for reducing corrosion in the overhead of a crude unit distillation tower by washing the raw crude oil with water to which has been added either a polymeric, hydrophilic, nitrogenous base, a di- or multivalent metallic base, a combination of a multi-polyether-headed surfactant and a monovalent metallic base, or any combination of the three.

In another embodiment of the invention, some polymeric, hydrophilic, non-quaternary ammonium nitrogenous bases and/or a hydrophobic, quaternary ammonium base are added to the crude oil, preferably in non-aqueous solvent. The crude can then be washed with water or fed directly to distillation.

DESCRIPTION OF THE RELATED ART

Alkali metal bases, such as NaOH and KOH, and small, hydrophilic amines, such as ethylenediamine, have been added to desalter wash water to adjust the effluent brine to a pH, between 5 and 9, more favorable to emulsification or demulsification, as taught in U.S. Pat. Nos. 5,114,566 and 4,992,210. This process is not entirely satisfactory, as even with the pH adjustment, at pH's below 9 adequate wetting cannot be achieved to penetrate the protective micelles and dissolve the salts, and adequate alkalinity is not achieved to neutralize the water insoluble acids, especially the weaker amine HCl's.

Addition of more of these types of soap forming bases, as taught in WO 97/08270, to achieve a more emulsifying, more neutralizing pH above the optimum for demulsification, which is always below 9, results in excessive emulsion stability. This decreases Cl removal and increases cation contamination by inhibiting demulsification.

The partial, or even full, neutralization of the stronger, carboxylic acids during desalting with larger amounts of less emulsifying base, too weak to achieve effluent brine pH's above 8, does not result in adequate overhead chloride reduction. Examples of these bases include overbased detergents such as calcium sulfonates or phenates, as taught in WO 97108275; hardness cation dispersants, such as anionic polyacrylates (including acids), as taught in U.S. Pat. No. 5,660,717; and hardness cation chelants, such as trisodium nitrilotriacetate, as taught in U.S. Pat. No. 4,992,164.

U.S. Pat. No. 5,626,742 teaches the use of caustic solutions (e.g., 10% NaOH) to extract crude oil at extremely high temperatures of 716° F. to 842° F. and pressures to remove sulfur species.

DETAILED DESCRIPTION OF THE INVENTION

The present invention relates to methods and compositions for reducing corrosion in the overhead of a crude unit distillation tower comprising washing the crude oil with water which contains either a polymeric hydrophilic nitrogenous base, a di- or multivalent metallic base, a combination of multi-polyether-headed surfactant and monovalent metallic base, or some combination of the three.

The polymeric hydrophilic nitrogenous bases that are useful in the present invention are those having a degree of polymerization (dp) of about 6 to 60,000, with a range of about 60 to 6000 preferred, and a carbon to nitrogen or oxygen ratio (C#/N,O) of less than 10. These compounds should be miscible with water and their aqueous solutions or alcoholic solution or dispersion should have a pH of at least 11 and preferably at least 12.

These compounds include but are not limited to polyetheramines, polyamines, polyimines, polypyridines, and poly(quaternary ammonium) bases having C#/N,O's of 1 to 10, and degrees of polymerization of about 6 to about 60,000.

The poly(quaternary ammonium) bases include the silicates, carbonates, and preferably, hydroxides of alkyl or alkylaryl quaternary amines. The preferred poly(quaternary ammonium) hydroxides (PQAH's) include but are not limited to poly(diallyldimethylammonium hydroxide) "poly (DADMAH)" having the formula:

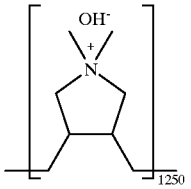

Poly(N,N-dimethyl, 2-hydroxypropyleneammonium hydroxide) "poly(DMHPAH)" having the formula:

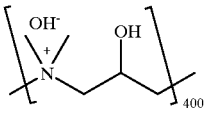

Poly[N,N-dimethyl, 3-(2-hydroxypropyleneamine) propylammonium hydroxide] "poly[DM(HPA)PAH]" having the formula:

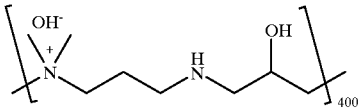

The poly(DADMAH) compound may be formed by reacting equimolar amounts of poly(diallyldimethyl ammonium) chloride, "poly(DADMAC)" with sodium hydroxide.

The poly(DMHPAH) compound may be formed by reacting equimolar amounts of 3-chloromethyl-1,2-oxirane (epichlorohydrin or EPI) with dimethylamine (DMA), and then sodium hydroxide.

The poly[DM(HPA)PAH] may be formed by reacting equimolar amounts of EPI and dimethylaminopropylamine (DMAPA), and then sodium hydroxide.

Representative examples of polyetheramines, polyamines, or polyimines include dimorpholinodiethyl ether (dp 6) derived from morpholine still bottoms, available from Huntsman Chemical as Amine C-6; poly(oxyethylene) diamines of dp 13, available from Huntsman Chemical as Jeffamine ED-600; and polyethyleneimine of dp 28, available from BASF as Polymin FG.

When the nitrogenous base is employed by itself, it is preferably added in an amount to achieve an effluent brine pH of at least 9, more preferably at least 10. This is typically in a range of about 4000 to about 12,000 parts active per million parts of wash water.

The di- or multivalent metallic bases include those that have an aqueous solution pH of at least about 11, preferably at least about 12. These include but are not limited to hydroxides, carbonates, and silicates of the more alkaline alkali earth metals, below $Mg^{+2}$ and $Be^{+2}$ on the periodic table, such as $Ca^{+2}$ and $Ba^{+2}$, as well as hydroxides of some amphoteric cations such as $Zn^{+2}$, $Al^{+3}$, and $Zr^{+4}$. Preferably, the di- or multivalent bases are $Ca(OH)_2$ and $Al(OH)_3$.

These are preferably added in an amount sufficient to achieve an effluent brine pH of at least 9, preferably about 10. Typically, about 2000 to about 12,000 parts active per million parts wash water will achieve this condition, or about 10 to about 600 parts per million parts crude oil The monovalent metallic bases comprise those having an aqueous solution pH of at least about 13, preferably at least about 14. These compounds are selected from the hydroxides, carbonates and silicates of the alkali metals: lithium, sodium, potassium, rubidium, cesium, and francium. The preferred monovalent metallic bases are sodium and potassium hydroxide.

They are preferably added in an amount sufficient to achieve an effluent brine pH of at least 9, preferably about 10. Typically, about 1000 to about 4000 parts active per million parts wash water will achieve this condition.

The multi-polyether-headed surfactants include those with hydrophobes (tails) comprising $C_3$ to $C_{18}$ alkyl, alkylaryl, or alkylether diols to polyols; $C_3$ to $C_{18}$ alkyl or alkylaryl 1° or 2° amines; and $C_3$ to $C_{18}$ alkylphenolic resins having a degree of polymerization greater than or equal to two (dp≧2). These are adducted with two or more hydrophilic heads per hydrophobe comprising chains of poly($C_2$ to $C_3$ alkylene oxide) of dp 3 to 30. Optionally, the hydrophobes or hydrophiles can be further crosslinked with aldehydes, epoxides or isocyanates.

Preferably, the multi-polyether-headed surfactant comprises branched nonylphenol-formaldehyde resins of dp 4 to 8 adducted with 4 to 8 chains of poly(ethylene oxide) of dp 4 to 7 blended with polypropylether diols of dp 30 to 50 adducted with 2 chains of poly(ethylene oxide) of dp 13 to 22.

They are preferably combined with the monovalent metallic base at a ratio sufficient for the mole fraction of alkaline or ether moieties on each molecule in the treatment times the number of alkaline or ether moieties on each molecule to be at least about 2.

When combined in water with monovalent metallic bases, these multi-polyether-headed surfactants are thought to form alkaline, polymeric, crown-ether-like organometallic complexes such as:

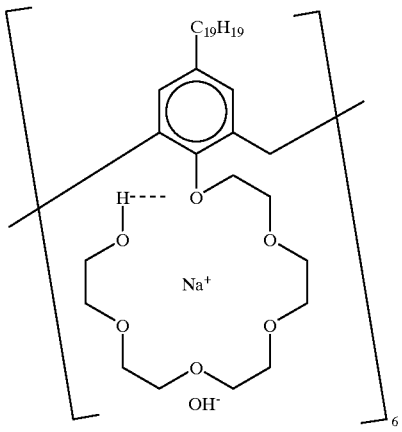

Typically, these multi-polyether-headed alkali metal complexed surfactants would be added from about 100 to about 1000 parts active per million parts of wash water.

Preferably, the ratio of multi-polyether-headed alkali metal complexed surfactant, polymeric nitrogenous base, or di- or multivalent metallic base to free monovalent metallic base is such that mean metal valence/polymer dp (Mean Val./dp) of the treatment, that is, the mole fraction of alkaline or ether moieties on each molecule in the treatment times the number of alkaline or ether moieties on each molecule, is at least 2.

Preferably, the nitrogenous base, the di- or multivalent base, the combination of multi-polyether-headed surfactant and monovalent metallic base, or some combination of the three are added so that the overall treatment raises the pH of the effluent brine of the wash system to at least 9 and preferably at least 10.

When the nitrogenous base and/or the combination of multi-polyether-headed surfactant and monovalent metallic base are employed in combination with the di- or multivalent base, the carryover of catalyst poisoning, monovalent, alkali metal adducts into the atmospheric tower resid can be lowered by increasing the ratio of di- or multivalent base to nitrogenous base and/or combination of multi-polyether-headed surfactant and monovalent metallic base. Preferably the ratio of di- or multivalent base to nitrogenous base and/or combination of multi-polyether-headed surfactant and monovalent metallic base ranges from about 1:20 to about 20: 1.

In another embodiment of the present invention, some polymeric, hydrophilic, non-quaternary ammonium, nitrogenous bases and/or hydrophobic, quaternary ammonium bases are added to the crude oil, preferably in non-aqueous solvent. The crude can then be washed with water or fed directly to distillation.

The polymeric, hydrophilic, non-quaternary ammonium, nitrogenous bases that are useful in the present invention are those having a degree of polymerization (dp) of about 6 to 60, with a range of about 6 to 30 preferred, and a carbon to nitrogen or oxygen ratio (C#/N,O) of less than 10. These compounds should be miscible with water and their aqueous solutions should have a pH of at least 11 and preferably at least 12.

These compounds include but are not limited to polyetheramines, polyamines, polyimines, and polypyridines having C#/N,O's of 1 to 10. Representative examples of polyetheramines, polyamines, or polyimines include dimorpholinodiethyl ether (dp 6) derived from morpholine still bottoms, available from Huntsman Chemical as Amine C-6; poly(oxyethylene)diamines of dp 13, available from Huntsman Chemical as Jeffamine ED-600; and polyethyleneimine of dp 28, available from BASF as Polymin FG.

The hydrophobic, quaternary ammonium bases are selected from those with aqueous dispersions or alcoholic solutions of pH of at least about 11, and preferably at least about 12. This includes but is not limited to the hydroxides, carbonates and alkaline silicates of alkyl or alkylaryl quaternary amines of 12 to 72 carbon atoms per quaternary nitrogen. Representative examples include tributylmethylammonium hydroxide (TBMAH) and dimethyltallow(3-trimethylammoniumpropylene) ammonium carbonate [DMT(TMAP)$ACO_3$].

These nitrogenous bases can be added as neat liquids or diluted in a non-aqueous, alcoholic or hydrocarbon solvent that is miscible in crude oil. These hydrocarbon solvents are selected from the group consisting of aromatic and olefinic hydrocarbons, $C_8$ or higher alcohols, and $C_4$ or lower alkyl ethers and esters. The hydrophobic, quaternary ammonium bases can be used to couple the polymeric, hydrophilic, non-quaternary ammonium, nitrogenous bases into otherwise immiscible organic solvents such as heavy aromatic naphthas.

When these nitrogenous bases are added to the crude, it is preferably in an amount sufficient to achieve an effluent brine pH of at least 9, more preferably at least 10. This is typically in a range of about 200 to about 600 parts active per million parts of crude oil. Mixtures of these classes of bases can be added at a ratio of about 1:1 to about 40:1.

The methods of the present invention are preferably employed in a two-stage, counterflow, refinery crude oil desalter. These desalters are typically operated between about 150° F. to about 300° F. The lower molecular weight (dp of 6 to 60) nitrogenous bases may be added neat or in an organic solvent to the interstage crude, from where they can wash into the interstage brine and flow back into the first stage to pretreat the incoming raw crude oil. The higher molecular weight (dp of 60 to 60,000) nitrogenous bases may be added as aqueous solutions to the interstage brine so that any residual metals can be rinsed out, and any waste phenols in the fresh wash water can be absorbed into the crude oil, in the second stage of the desalter. This method of addition is also preferred for the di- or multivalent metallic base and the combination of multi-polyether-headed surfactants and monovalent metallic base.

The following examples are intended to demonstrate the efficacy of the present invention and should not be construed at limiting the scope thereof.

An experiment was performed to determine the ability of certain reagents to remove overhead acid producing species in a desalter-like aqueous extraction without forming stable emulsions that would preclude their use in such systems. A raw crude oil with a Neutralization or Total Acid Number (TAN) of 1.8 mg KOH/g and a Saponification Number of 8.1 mg KOH/g was added to a baffled glass pressure vessel. To this was added 5% tap water, 12.4 ppm active of a multi-polyether-headed surfactant (MPEHS), and various amounts of either of two conventional neutralization agents: sodium hydroxide (NaOH) or ethylenediamine (EDA). The MPEHS comprised a blend of branched nonylphenolic resins of dp 4–8 adducted with 4–8 chains of poly(ethylene oxide) each with a dp of 4–7, and polypropylether diols of dp 30–50 adducted with 2 chains of poly(ethylene oxide) each of dp 13–22.

The vessel was sealed, heated to 250° F., mixed with a four-bladed propeller close in diameter to that of the vessel at 7000 RPM for 1 second to form an emulsion, then placed in 4 kV/in., 60 Hz electric field at 250° F. for 64 minutes.

The rate at which the emulsion resolved was measured by recording, at exponentially increasing time intervals, the amount of water which had broken free to the bottom of the vessel and averaging those readings (termed the Mean Water Drop or MWD).

The upper 75% of the settled emulsion was then transferred to a steam/vacuum distillation column. Here it was heated to 600° F. for 20 minutes then sparged with steam for 10 minutes. To simulate a refinery vacuum tower, the pressure on the column was then reduced to 5 psi and the temperature increased to 850° F. for 30 minutes. About 77% of the crude oil distilled overhead. The TAN of the distillate was then measured. These results are reported in Table I.

100 ppm active of a desalting demulsifier, heating to 300° F. in a sealed, baffled mixing vessel, mixing with a four bladed propeller close in diameter to that of the vessel at 16,000 RPM for 5 seconds to form an emulsion, settling in a 4 kV/in., 60 HZ electric field at 300° F. for as long as it took for the emulsion to completely resolve, removing the aqueous phase and determining its Cl content with an Ion Chromatograph. The result, expressed as ptb (pounds/thousand barrels) NaCl based on the original crude oil, was termed the "Extractable Cl's" (ExCl).

The (steam) distillability of the Cl's was determined by adding the crude oil to a steam distillation column, heating it to 730° F. for 20 minutes, sparging with the steam produced from 3% water for 10 minutes, collecting the overhead condensate (about 75% of the crude oil) through a trap containing 0.1 N NaOH, removing the aqueous solution in the trap, and determining its Cl content with an Ion Chromatograph. The result, expressed as ptb NaCl based on the original crude oil, was termed the "Hydrolyzable Cl's" (HyCl). The steam distillability of the extracted crude oil was also determined by subjecting the upper 83% of the

TABLE I

Crude Unit Simulation Results
Southwest Refinery

| Treatment | | | | | | | | Demulsification | | | Overhead | |
|---|---|---|---|---|---|---|---|---|---|---|---|---|
| MPEHS Dose | | Alkaline Agent | | | | | Mean | | (MWD/ | Effluent | TAN/ | (TAN/ |
| | | | Sol. | C#/ | Dose | | Val./ | MWD | $MWD_o$) − 1 | Brine | Raw TAN | $TAN_o$) − 1 |
| ppm | mN | Name | pH | N, O | ppm | mN | dp | % | D % | Ph | % | D % |
| 12.4 | 0.14 | none | | | 0 | 0 | 30.0 | 2.81 | 0 | 5 | 86 | 0 |
| 12.4 | 0.14 | Ethylene diamine | 12.5 | 1 | 6 | 0.2 | 12.8 | 2.76 | −2 | 5 | 86 | 0 |
| 12.4 | 0.14 | Ethylene diamine | 12.5 | 1 | 60 | 2 | 2.9 | 2.47 | −12 | 5 | 86 | 0 |
| 12.4 | 0.14 | Ethylene diamine | 12.5 | 1 | 600 | 20 | 1.2 | 0.49 | −83 | 9.5 | 86 | 0 |
| 12.4 | 0.14 | NaOH, aq | 14 | 0 | 4 | 0.1 | 18.0 | 2.62 | −7 | 5 | 86 | 0 |
| 12.4 | 0.14 | NaOH, aq | 14 | 0 | 40 | 1 | 4.5 | 1.20 | −57 | 5 | 86 | 0 |
| 12.4 | 0.14 | NaOH, aq | 14 | 0 | 400 | 10 | 1.4 | 0.20 | −97 | 9.5 | 61 | −29 |
| 12.4 | 0.14 | NaOH, aq | 14 | 0 | 1200 | 30 | 1.1 | 0.36 | −87 | 10 | 22 | −75 |
| 12.4 | 0.14 | NaOH, aq | 14 | 0 | 2400 | 60 | 1.1 | 0.77 | −73 | 10.5 | 39 | 55 |

where mN denotes the millimoles per liter of alkaline or ether groups (=OH or ROR equivalents).

These results demonstrate that overhead distilled acids were not reduced by washing the crude with water containing conventional neutralizers under refinery crude unit conditions until the pH of the effluent brine leaving the desalter had been elevated to the 9.5–10.0 level. However, more stable emulsions began to form by pH 7. By pH 9.5, when the overhead acids began to be reduced, the emulsions were essentially unbreakable by conventional means.

A series of experiments were then performed to discover novel reagents that could remove at the desalter the species responsible for specific overhead acids, particularly the most corrosive acid, HCl, without forming stable emulsions. The extractability and distillability of the chloride species in the crude were characterized as follows:

Extractability was determined by diluting the crude in an equal part of toluene, adding an equal part water, dosing with settled oil phase left over from the extractability test to the same distillation as above, after a room temperature, thin film (rotary), vacuum evaporation to remove the toluene. This was termed the "Non-Extractable, Hydrolyzable Cl's" (NxHyCl). By subtraction, the "Extractable, Non-Hydrolyzable Cl's" (ExNHCl) can be calculated. "Non-Extractable, Non-Hydrolyzable Cl's" (NxNHCl), undetected in previous studies and irrelevant to this one, were assumed to be zero for the convenience of expressing a grand total.

A raw crude of Middle Eastern origin was studied and had the following characteristics:

| | Chloride Salts in Crude (ptb as NaCl) | | |
|---|---|---|---|
| | Hydrolyzable | Non-Hydrolyzable | Total |
| Extractable | 3.2 | 7.9 | 11.1 |
| Non-Extractable | 0.0 | 0.0 | 0.0 |
| Total | 3.2 | 7.9 | 11.1 |

An experiment was performed to determine the ability of candidate reagents to remove overhead HCl producing species in a desalter-like aqueous extraction without forming stable emulsions that would preclude their use in such systems. The raw crude oil was added to a baffled glass pressure vessel. To this was added 5% tap water, an MPEHS of the same type as employed in the previous study (results in Table I), and one of various unconventional reagents and controls.

The vessel was sealed, heated to 250° F., mixed as above but at 16,000 RPM for 2 seconds to form an emulsion, then placed in a 4 kV/in. 60 Hz electric field at 250° F. for 64 minutes. The rate at which the emulsion resolved was measured as above. The upper 90% of the settled emulsion was transferred to a steam distillation column. Here it was heated to 730° F. for 20 minutes then sparged with steam produced from 3% water for 10 minutes. The overhead condensate (about 75% of the crude oil) was accumulated by sparging through a trap containing 0.1 N NaOH. The aqueous solution in the trap was collected, and its Cl content determined with an Ion Chromatograph. The result, expressed as ptb NaCl based on the original crude oil, was termed the "Unextracted Hydrolyzable Cl's" (UnXHyCl). The results of this testing are reported in Table II.

TABLE II

Crude Unit Simulation Results
Middle Eastern Crude

| Treatment | | | | | | | | Demulsification | | | Overhead | |
|---|---|---|---|---|---|---|---|---|---|---|---|---|
| MPEHS Dose | | Alkaline Agent | | | | | Mean | | (MWD/ | Effluent | HCl/ Raw | (HCl/ |
| | | | Sol. | C#/ | Dose | | Val./ | MWD | $MWD_o$) − 1 | Brine | Cl | $HCl_o$) − 1 |
| ppm | mN | Name | pH | N, O | ppm | mN | dp | % | Δ % | pH | % | Δ % |
| 0 | 0 | none | | | 0 | 0 | | 3.83 | 0 | 8.1 | 28.9 | 0 |
| 0 | 0 | NaOH, aq. | 14 | 0 | 40 | 1 | 1 | 2.15 | −44 | 12.0 | <0.9 | <−97 |
| 0 | 0 | NaOH, aq. | 14 | 0 | 200 | 5 | 1 | 0.93 | −76 | 12.4 | <0.9 | <−97 |
| 0 | 0 | NaOH, aq. | 14 | 0 | 800 | 20 | 1 | 1.13 | −71 | 12.9 | <0.9 | <−97 |
| 3 | .03 | none | | | 0 | 0 | 30.0 | 4.52 | 0 | | 11.8 | 0 |
| 3 | .03 | NaOH, aq. | 14 | 0 | 40 | 1 | 1.9 | 2.17 | −52 | | <0.9 | <−92 |
| 3 | .03 | NaOH, aq. | 14 | 0 | 200 | 5 | 1.2 | 0.92 | −80 | | <0.9 | <−92 |
| 3 | .03 | $Ca(OH)_2$, aq. | 12.7 | 0 | 37 | 1 | 2.9 | 4.04 | −11 | | 9.2 | −22 |
| 3 | .03 | $Ca(OH)_2$, aq. | 12.7 | 0 | 185 | 5 | 2.2 | 3.85 | −15 | | 6.9 | −41 |
| 3 | .03 | CaO, triglyme | 12.7 | 0 | 28 | 1 | 2.9 | 4.25 | −6 | | 10.8 | −8 |
| 3 | .03 | CaO, triglyme | 12.7 | 0 | 140 | 5 | 2.2 | 3.90 | −14 | | 12.7 | 8 |
| 3 | .03 | Dimorpholino-diethyl ether | 12 | 2.4 | 18.5 | 0.5 | 7.6 | 4.32 | −4 | | 11.3 | −5 |
| 3 | .03 | $H_2NPO(EO)_{11}PNH_2$ | 12.8 | 2 | 30 | 0.7 | 13.8 | 4.09 | −10 | | 7.1 | −41 |
| 3 | .03 | Polyethylene-imine | 12.7 | 2 | 8.6 | 0.2 | 28.3 | 4.22 | −7 | | 9.3 | −21 |
| 3 | .03 | Choline | 13 | 2.5 | 100 | 1 | 1.9 | 0.93 | −79 | | 6.9 | −41 |
| 3 | .03 | tributylmethyl-amonium hydroxide | 13 | 13 | 58 | 0.3 | 4.0 | 3.59 | −21 | | 8.5 | −28 |
| 3 | .03 | DMT(TMAP)A—$CO_3$ | 13 | 13 | 200 | 0.9 | 3.0 | 4.25 | −6 | | 7.0 | −41 |
| Treatment | | | | | | | | Demulsification | | | HCl/ | |
| MPEHS Dose | | Acidic Chelants | | | | | Mean | | (MWD/ | Effluent | Raw | (HCl/ |
| | | | Sol. | C#/ | Dose | | Val./ | MWD | $MWD_o$) − 1 | Brine | Cl | $HCl_o$) − 1 |
| ppm | mN | Name | pH | N, O | ppm | mN | dp | % | Δ % | pH | % | Δ % |
| 3 | .03 | $(CO_2H)_2$, aq. | 1 | 0.5 | 45 | 1 | 2.9 | 3.71 | −18 | | 16.2 | 37 |
| 3 | .03 | $(CO_2H)_2$, aq. | 1 | 0.5 | 225 | 5 | 2.2 | 3.69 | −18 | | 14.2 | 21 |
| Non-Alkaline N Compounds | | | | | | | | | | | | |

TABLE II-continued

| Crude Unit Simulation Results Middle Eastern Crude | | | | | | | | | | | |
|---|---|---|---|---|---|---|---|---|---|---|---|
| 3 | .03 | T(HE)TAA + $B(OE)_{7.5}$MODAC 1:2 | 4 | 4 | 7.5 | .09 | 15.6 | 4.5 | 0 | 15.2 | 29 |
| 3 | .03 | Dimethylcocoamine oxide | 11 | 7.5 | 6 | .03 | 17.4 | 3.95 | −13 | 13.2 | 12 |
| 3 | .03 | N-Methyl Pyrrolidinone | 7 | 2.5 | 50 | .51 | 2.8 | 3.47 | −23 | 12.7 | 8 |

T(HE)TAA is tris(2-hydroxyethyl)tallowammonium acetate (e.g. Akzo Ethoquad T/13-Ac).
$B(OE)_{7.5}$MODAC is bis(oxyethyl)$_{7.5}$methyloctadecylammonium chloride (e.g. Akzo Ethoquad 18/25).
Dimethylcocoamine oxide is available from Akzo as Aromox C-12.
Dimorpholinodiethyl ether is derived from morpholine still bottoms (e.g. Huntsman Amine C-6).
$H_2NPO(EO)_{11}PNH_2$ is available from Huntsman as Jeffamine, ED-600.
Polyethyleneimine of dp 28 is available BASF as Polymin FG.
DMT(TMAP)A—$CO_3$ is dimethyltallow(3-trimethylammoniumpropylene)ammonium carbonate.

These results demonstrate that alkaline, hydrophilic, polymeric amines (polyamines or polyetheramines) of dp 6–28 and C# per N or O of about 2; alkaline, hydrophobic quaternary mono- or di-ammonium hydroxides or carbonates of C# per quaternary N of about 13; and metallic, divalent bases at least as alkaline as calcium hydroxide or oxide are able to remove into the effluent water some of the overhead HCl producing moieties not removed by wash water alone without decelerating the demulsification rate by more than about 21% MWD, often by less than 7% MWD. This is small enough to maintain the operation of the desalter, as explained below.

Non-alkaline amines, such as amine oxides and quaternary amine chlorides and acetates, amides, and non-alkaline chelants, such as oxalic acid, also had little effect on the demulsification but actually pushed more overhead HCl producing moieties into the desalted oil. Alkaline, hydrophilic, monomeric amines, such as choline hydroxide, a quaternary monoamine alkoxylate of C# per quaternary N of 5, and metallic, monovalent bases, such as NaOH, also removed into the wash water some to all of the overhead HCl producing moieties not removed by wash water alone but decelerated the demulsification rate by more than 50% MWD, usually by more than 75% MWD. This value is too large to maintain the operation of the desalter, as explained below.

When predicting the effect of a change in the MWD on the operation of the desalter, remember that the water drop readings are taken at exponentially increasing intervals (reflecting the exponential decay of the residual water in the batch of emulsified oil). A 50% drop in the MWD can thus reflect a 32 fold drop in the rate of demulsification. For example (from Table II):

| Treatment | | Water Drop Readings in % | | | | | | | |
|---|---|---|---|---|---|---|---|---|---|
| MPEHS ppm | NaOH ppm | 1 min. | 2 min. | 4 min. | 8 min. | 16 min. | 32 min. | 64 min. | Mean (MWD) |
| 3 | 0 | 3.5 | 4.0 | 4.5 | 4.7 | 4.7 | 5.0 | 5.2 | 4.51 |
| 3 | 40 | 0.6 | 1.1 | 1.6 | 2.0 | 2.7 | 3.4 | 3.8 | 2.17 |

To appreciate the physical significance of this, remember that the equilibrium dispersion height (emulsion pad or rag layer thickness) in a continuously fed desalter is proportional to the rate at which the emulsion breaks. Thus a 32 fold reduction in the demulsification rate would raise a typical 1' dispersion height in a 12' diameter vessel to an impossible 32', shutting the unit down.

A raw crude oil of mixed South American and Middle Eastern origin containing a different set of Cl species was studied. The Cl salt content was characterized as follows:

| Chloride Salts in Crude (ptb as NaCl) | | | |
|---|---|---|---|
| | Hydrolyzable | Non-Hydrolyzable | Total |
| Extractable | 8.8 | 10.5 | 19.3 |
| Non-Extractable | 6.4 | 0.0 | 6.4 |
| Total | 15.2 | 10.5 | 25.7 |

Tests simulating the crude unit were run as described above, except that the desalter emulsion was made by mixing at 280° F. for 1 second, reflecting the local processing parameters. The results of this testing are reported in Table III.

TABLE III

Crude Unit Simulation Results
Mixed South American/Middle Eastern Crude

| Treatment | | | | | | | | Demulsification | | Overhead | |
|---|---|---|---|---|---|---|---|---|---|---|---|
| MPEHS Dose | | Alkaline Agent | | | | | Mean | | (MWD/ | HCl/ Raw | (HCl/ |
| | | | Sol | C#/ | Dose | | Val./ | MWD | $MWD_o$) − 1 | HCl | $HCl_o$) − 1 |
| ppm | mN | Name | pH | N, O | ppm | mN | dp | % | Δ % | % | Δ % |
| 4 | .04 | none | | | 0 | 0 | 30 | 3.38 | 0 | 71 | 0 |
| 12 | .13 | none | | | 0 | 0 | 30 | 3.88 | 15 | 73 | 3 |
| 4 | .04 | Dimorpholinodi-ethyl ether | 12 | 2 | 20 | 0.5 | 11 | 3.40 | 1 | 61 | −15 |
| 4 | .04 | Dimorpholinodi-ethyl ether | 12 | 2 | 40 | 1.0 | 7 | 3.24 | −4 | 50 | −30 |
| 4 | .04 | $Ca(OH)_2$ + KOH, 1:1 by wt. | 14 | 0 | 4 | 0.09 | 11 | 3.39 | 0 | 14 | −81 |

These results confirm that alkaline, hydrophilic, polymeric amines alone and alkaline, divalent, metal hydroxides, combined in this case with an equal amount of a monovalent metal hydroxide, KOH, can remove into the wash water some to most of the overhead HCl producing moieties not removed by wash water alone without decelerating the demulsification rate by more than about 4% MWD, if at all. The latter treatment even succeeds in removing a portion of the NxHyCl's.

Further studies were performed on a Gulf of Mexico crude having the following salt characteristics.

| | Chloride Salts in Crude (ptb as NaCl) | | |
|---|---|---|---|
| | Hydrolyzable | Non-Hydrolyzable | Total |
| Extractable | 8.9 | 103.1 | 112.0 |
| Non-Extractable | 0.0 | 0.0 | 0.0 |
| Total | 8.9 | 103.1 | 112.0 |

About half of the filterable solids in this crude were found to be, after cleaning with toluene, water soluble salts. Tests simulating the crude unit were run as described above, except that the desalter emulsion was made by mixing at 220° F. for 2 seconds, reflecting the local processing parameters. These results are reported in Table IV.

TABLE IV

Crude Unit Simulation Results
Gulf of Mexico Crude

| Treatment | | | | | | | | Demulsification | | Effluents | | | | | Overhead | |
|---|---|---|---|---|---|---|---|---|---|---|---|---|---|---|---|---|
| MPEHS Dose | | Alkaline Agents | | | | | Mean | | (MWD/ | | Salt in Des. Crude | | | | HCl/ | (HCl/ |
| | | | Sol | C#/ | Dose | | Val./ | MWD | $MWD_o$) − 1 | Brine | Na + K, ICP | | NaCl, SC | | Raw CI | $HCl_o$) − 1 |
| ppm | mN | Name | pH | N, O | ppm | mN | dp | % | Δ % | pH | ppm | Δ % | ptb | Δ % | % | Δ % |
| 1 | .01 | none | | | 0 | 0 | | 4.97 | 0 | 5.3 | 10 | 0 | 8.3 | 0 | 2.8 | 0 |
| 1 | .01 | $Ca(OH)_2$ + KOH 1:1 | 14 | 0 | 1 | 0.02 | 11.1 | 5.05 | 2 | 5.7 | 9 | −10 | 7.6 | −8 | 3.2 | 16 |
| 1 | .01 | $Ca(OH)_2$ + KOH 1:1 | 14 | 0 | 2.5 | 0.06 | 6.3 | 5.06 | 2 | 5.8 | 9 | −10 | 6.6 | −20 | 3 | 10 |
| 1 | .01 | $Ca(OH)_2$ + KOH 1:1 | 14 | 0 | 5 | 0.11 | 4.2 | 5.05 | 2 | 6.3 | 4 | −60 | 6.8 | −18 | 3.3 | 19 |
| 1 | .01 | $Ca(OH)_2$ + KOH 1:1 | 14 | 0 | 10 | 0.22 | 3.0 | 5.11 | 3 | 6.5 | 11 | 10 | 12 | 51 | 2.5 | −10 |
| 1 | .01 | $Ca(OH)_2$ + KOH 1:1 | 14 | 0 | 20 | 0.45 | 2.3 | 5.12 | 3 | 6.3 | 10 | 0 | 8.3 | 0 | 2 | −29 |
| 1 | .01 | $Ca(OH)_2$ + KOH 1:1 | 14 | 0 | 40 | 0.90 | 1.9 | 5.24 | 5 | 6.7 | 10 | 0 | 8.4 | 1 | 2.3 | −16 |
| 1 | .01 | $Ca(OH)_2$, aq | 13 | 0 | 2 | 0.05 | 6.7 | 5.06 | 2 | 6.5 | 13 | 30 | 12 | 45 | 3.1 | 13 |
| 1 | .01 | $CaS_5$, aq. | 12 | 0 | 6 | 0.06 | 6.3 | 5.08 | 2 | 6.3 | 4 | −60 | 6.6 | −20 | 2.9 | 6 |

TABLE IV-continued

| Crude Unit Simulation Results Gulf of Mexico Crude | | | | | | | | | | | | | | | | |
|---|---|---|---|---|---|---|---|---|---|---|---|---|---|---|---|---|
| Treatment | | | | | | | Demulsification | | | Effluents | | | | | Overhead | |
| MPEHS | | Alkaline Agents | | | | | Mean | | (MWD/ | | Salt in Des. Crude | | | | HCl/ | (HCl/ |
| Dose | | | Sol | C#/ | Dose | | Val./ | MWD | $MWD_o$) − 1 | Brine | Na + K, ICP | | NaCl, SC | | Raw CI | $HCl_o$) − 1 |
| ppm | mN | Name | pH | N, O | ppm | mN | dp | % | Δ % | pH | ppm | Δ % | ptb | Δ % | % | Δ % |
| 1 | .01 | $Ca(OH)_2$ + KOH 1:1 | 14 | 0 | 10 | 0.22 | 3.0 | 5.11 | 3 | 6.5 | 11 | 10 | 12 | 51 | 2.5 | −10 |
| 1 | .01 | $Ca(OH)_2$ + KOH 1:1 | 14 | 0 | 20 | 0.45 | 2.3 | 5.12 | 3 | 6.3 | 10 | 0 | 8.3 | 0 | 2 | −29 |
| 1 | .01 | $Ca(OH)_2$ + KOH 1:1 | 14 | 0 | 40 | 0.90 | 1.9 | 5.24 | 5 | 6.7 | 10 | 0 | 8.4 | 1 | 2.3 | −16 |
| 1 | .01 | $Ca(OH)_2$, aq | 13 | 0 | 2 | 0.05 | 6.7 | 5.06 | 2 | 6.5 | 13 | 30 | 12 | 45 | 3.1 | 13 |
| 1 | .01 | $CaS_5$, aq. | 12 | 0 | 6 | 0.06 | 6.3 | 5.08 | 2 | 6.3 | 4 | −60 | 6.6 | −20 | 2.9 | 6 |
| 1 | .01 | Dimorpholinodiethyl ether | 12 | 2 | 10 | 0.25 | 7.0 | 5.03 | 1 | 6.8 | 10 | 0 | 13 | 61 | 3 | 10 |
| 1 | .01 | Dimorpholinodiethyl ether | 12 | 2 | 20 | 0.49 | 7.6 | 4.93 | −1 | 7.2 | 7 | −30 | 5.7 | −30 | 2.1 | −23 |
| 1 | .01 | PolyDMHPA: $H_3SiO_4$ + $NaH_3SiO_4$ | 10 | 2.5 | 1.8 + 6.9 | 0.01 + 0.05 | 56 | 5.19 | 4 | 6.5 | 14 | 40 | 10 | 27 | 3.4 | 23 |

DMHPA:$H_3S:O_4$ is N, N-dimethyl, 2-hydroxypropyleneammonium metasilicate.

These results demonstrate that in this crude, it was much harder to remove the overhead HCL producing moieties not removed by wash water alone but also much easier to keep from decelerating the demulsification rate.

Conversely, some treatments which did not remove additional HCl producers directly did allow them to be removed indirectly by removing additional alkali metals (Na and K). This allowed caustic to be added to the desalted crude to reduce the level of HCl going overhead without increasing the level of alkali metal catalyst poisons in the atmospheric tower resid. It is believed that these effects are due to this crude being appreciably more acidic than the previous two. The addition of alkaline agents at dosages similar to that which rendered the extraction water (as measured in the effluent) alkaline in other crudes did not render this extraction water alkaline. Thus, the HCl precursor moieties weremostly not converted into water extractable form, but neither, for the most part, were the naphthenic acid emulsifier precursors converted into soaps. Just enough may have been converted to allow better cleaning, and thus extraction, of crystalline alkali metal salts.

Further studies were performed on a crude oil of Middle Eastern and African origin having the following salt characteristics.

| Chloride Salts in Crude (ptb as NaCl) | | | |
|---|---|---|---|
| | Hydrolyzable | Non-Hydrolyzable | Total |
| Extractable | 4.2 | 0.9 | 5.1 |
| Non-Extractable | 1.6 | 0.0 | 1.6 |
| Total | 5.8 | 0.9 | 6.7 |

Testing was performed as described above, except that the desalter emulsion was made by mixing at 260° F. at 13,000 RPM, reflecting the local processing parameters. The results of this testing are reported in Table V.

TABLE V

Crude Unit Simulation Results
Middle Eastern and African Crude

| Treatment | | | | | | | | Demulsification | | | Overhead | |
|---|---|---|---|---|---|---|---|---|---|---|---|---|
| MPEHS Dose | | Alkaline Agent | | | | | Mean | | (MWD/ | Effluent | HCl/ Raw | (HCl/ |
| | | | Sol | C#/ | Dose | | Val./ | MWD | $MWD_o$) − 1 | Brine | Cl | $HCl_o$) − 1 |
| ppm | mN | Name | pH | N, O | ppm | mN | dp | % | Δ % | pH | % | Δ % |
| 1.1 | .01 | none | | | 0 | 0 | 30 | 4.03 | 0 | 4.8 | 28 | 0 |
| 5.4 | .06 | none | | | 0 | 0 | 30 | 4.87 | 21 | 4.3 | 30 | 7 |
| 1.1 | .01 | $Ca(OH)_2$ + KOH 1:1 | 14 | 0 | 1.4 | 0.03 | 9.5 | 4.18 | 4 | 4.8 | 31 | 7 |
| 1.1 | .01 | Dimorpholinodi-ethyl ether | 12 | 2 | 14 | 0.34 | 6.8 | 4.51 | 12 | 5.2 | 21 | −25 |
| 0 | 0 | none | 0 | 0 | 0 | 0 | 0 | 1.81 | −55 | 4.9 | 30 | 7 |
| For remaining tests, phenol laden wash water had aged into more acidic state. | | | | | | | | | | | | |
| 1.1 | .01 | none | | | 0 | 0 | 30 | 3.95 | 0 | 3.8 | 42 | 0 |
| 4.3 | .05 | none | | | 0 | 0 | 30 | 4.24 | 7 | 3.2 | 45 | 7 |
| 2.2 | .02 | Dimorpholinodi-ethyl ether | 12 | 2 | 28 | 0.68 | 7.9 | 4.62 | 17 | 5.4 | 33 | −21 |
| 2.2 | .02 | Dimorpholinodi-ethyl ether | 12 | 2 | 42 | 1.03 | 6.5 | 4.62 | 17 | 5.7 | 29 | −31 |
| 1.1 | .01 | Dimorpholinodi-ethyl etlier | 12 | 2 | 7 | 0.17 | 7.6 | 4.77 | 20 | 4.7 | 33 | −21 |
| 2.2 | .02 | Dimorpholinodi-ethyl ether | 12 | 2 | 14 | 0.34 | 7.6 | 4.51 | 14 | 4.9 | 30 | −29 |
| 2.2 | .02 | $CaS_5$, aq | 12 | 0 | 8.4 | 0.08 | 8.5 | 4.43 | −2 | 4.4 | 33 | −21 |
| 4.3 | .05 | $CaS_5$, aq | 12 | 0 | 16.8 | 0.15 | 8.5 | 4.19 | 12 | 4.5 | 37 | −12 |
| 2.2 | .02 | $Ca(OH)_2$, aq | 13 | 0 | 28 | 0.76 | 2.4 | 3.97 | 1 | 8.8 | 35 | −17 |
| 4.3 | .05 | $Ca(OH)_2$, aq | 13 | 0 | 56 | 1.51 | 2.4 | 4.35 | 10 | 9.4 | 35 | −17 |
| 2.2 | .02 | $Li_2CO_3$, aq | 11 | 0.3 | 28 | 0.76 | 1.9 | 3.46 | −12 | 9.1 | 34 | −19 |
| 4.3 | .05 | $Li_2Co_3$, aq | 11 | 0.3 | 56 | 1.51 | 1.9 | 4.01 | 2 | 9.3 | 40 | −5 |
| 2.2 | .02 | $Na_4CS_4$, aq | 10 | 1 | 9 | 0.15 | 5.0 | 3.76 | −5 | 3.6 | 42 | 0 |
| 4.3 | .05 | $Na_4CS_4$, aq | 10 | 1 | 17.9 | 0.31 | 5.0 | 3.77 | −5 | 3.9 | 33 | −21 |
| 1.1 | .01 | NaOH, aq | 14 | 0 | 22.4 | 0.56 | 1.6 | 3.47 | −12 | 8 | 24 | −43 |
| 1.1 | .01 | NaOH, aq | 14 | 0 | 67.2 | 1.68 | 1.2 | 0 | −100 | >10 | <1 | <−97 |
| 2.2 | .02 | NaOH, aq | 14 | 0 | 11.2 | 0.28 | 3.3 | 4.43 | 12 | 6.5 | 32 | −24 |
| 2.2 | .02 | NaOH, aq | 14 | 0 | 33.6 | 0.84 | 1.8 | 2.06 | −48 | 8.8 | 24 | −43 |
| 4.3 | .05 | NaOH, aq | 14 | 0 | 22.2 | 0.56 | 3.3 | 3.59 | −9 | 8.0 | 23 | −45 |
| 4.3 | .05 | NaOH, aq | 14 | 0 | 67.2 | 1.68 | 1.8 | 0 | −100 | >10 | <1 | <−97 |
| 8.7 | .10 | NaOH, aq | 14 | 0 | 22.2 | 0.56 | 5.3 | 3.8 | −4 | 6.3 | 23 | −45 |
| 17.4 | .19 | NaOH, aq | 14 | 0 | 67.2 | 1.68 | 4.0 | 0 | −100 | >10 | <1 | <−97 |
| 17.4 | .19 | NaOH, aq | 14 | 0 | 44.8 | 1.12 | 5.3 | 1.33 | −66 | −9.5 | | |
| 17.4 | .19 | NaOH, aq | 14 | 0 | 56 | 1.4 | 4.5 | 1.04 | −70 | −10 | | |
| 17.4 | .19 | NaOH + $Al(OH)_3$ + Poly(DADMAH) | 14 | 8 | 26 + 58.5+ 10.4 | 0.67 + 2.25 + 0.073 | 33 | 0.31 | −92 | −8 | | |
| 17.4 | .19 | NaOH + $Al(OH)_3$ + Poly(DADMAH) | 14 | 8 | 33.7+ 72.8+ 13.0 | 0.84 + 2.80 + 0.091 | 33 | 0.26 | −93 | ~9 | | |
| 17.4 | .19 | NaOH + $Al(OH)_3$ + Poly(DADMAH) | 14 | 8 | 40.4+ 87.4+ 15.6 | 1.01 + 3.36 + 0.109 | 33 | 0 | −100 | ~9.5 | | |
| 17.4 | .19 | NaOH + $Al(OH)_3$ + Poly(DADMAH) | 14 | 8 | 34.0+ 35.1+ 6.3 | 0.85 + 1.35 + 0.044 | 27 | 2.10 | −47 | 9.3 | 14.6 | −65 |
| 17.4 | .19 | NaOH + $Al(OH)_3$ + Poly(DADMAH) | 14 | 8 | 42.6+ 43.7+ 7.9 | 1.06 + 1.68 + 0.055 | 27 | 1.44 | −64 | 9.6 | 3 | −93 |
| 17.4 | .19 | NaOH + $Al(OH)_3$ + Poly(DADMAH) | 14 | 8 | 51.2+ 52.5+ 9.3 | 1.28 + 2.02 + 0.065 | 26 | 1.77 | −55 | 9.8 | <1 | <−97 |

These tests were continued on a new crude sample, nominally of the same crude slate, having the following Cl salt characteristics.

| | Chloride Salts in Crude (ptb as NaCl) | | |
|---|---|---|---|
| | Hydrolyzable | Non-Hydrolyzable | Total |
| Extractable | 2.5 | 6.6 | 9.1 |
| Non-Extractable | 2.2 | 0.0 | 2.2 |
| Total | 4.7 | 6.6 | 11.3 |

This crude differed from the preceding one primarily in its Na content, which was 7 ppm (by ashing/ICP) vs. <1 ppm on the other. The results of this testing are reported in Table VI.

di- or trivalent, metal hydroxides or sulfides, especially in combination with alkaline monovalent metal hydroxides such as NaOH. These results demonstrate that the key to removing most, or even, on some crudes, any significant portion of the overhead HCl precursors is getting the extraction water pH above about 9 and preferably, for near complete removal, above about 10.

It has been discovered that the key to achieving this result without unduly decelerating the demulsification rate is using a treatment with an average metal valence or polymer dp, that is, the mole fraction of alkaline or ether moieties on each molecule in the treatment times the number of alkaline or ether moieties on each molecule, of at least 2, preferably more than 5, most preferably more than 50. These results

TABLE VI

Crude Unit Simulation Results
Middle Eastern and African Crude

| Treatment | | | | | | | | Demulsification | | Effluents | | | Overhead | |
|---|---|---|---|---|---|---|---|---|---|---|---|---|---|---|
| MPEHS Dose | | Alkaline Agent | | | | | Mean | | (MWD/ | | Crude | | HCl Raw Cl | HCl/ |
| | | | Sol | C#/ | Dose | | Val./ | MWD | $MWD_o$) − 1 | Brine | Na + K, ICP | | | $HCl_o$) − 1 |
| ppm | mN | Name | pH | N, O | ppm | mN | dp | % | Δ % | pH | ppm | Δ % | % | Δ % |
| 17.4 | .19 | Poly[DM(HPA)PA H] +NaOH | 14 | 2.6 | 1.3 + 55 | .014 + 1.4 | 8.0 | 4.00 | −7 | | | | | |
| 17.4 | .19 | Poly[DM(HPA)PA H] + NaOH | 14 | 2.6 | 2.6 + 55 | .028 + 1.4 | 11 | 4.19 | −2 | | | | | |
| 17.4 | .19 | Poly[DM(HPA)PA H] + NaOH | 14 | 2.6 | 5.3 + 54 | .056 + 1.3 | 18 | 4.89 | 14 | | | | | |
| 17.4 | .19 | Poly[DM(HPA)PA H] + NaOH | 14 | 2.6 | 10.7 + 52 | .113 + 1.3 | 31 | 5.64 | 31 | | | | | |
| 17.4 | .19 | Poly(DADMAH) + NaOH | 14 | 8 | 1.3 + 56 | .009 + 1.4 | 12 | 3.96 | −8 | | | | | |
| 17.4 | .19 | Poly(DADMAH) + NaOH | 14 | 8 | 2.7 + 55 | .019 + 1.4 | 19 | 4.31 | 1 | | | | | |
| 17.4 | .19 | Poly(DADMAH) + NaOH | 14 | 8 | 5.4 + 55 | .037 + 1.4 | 33 | 4.52 | 5 | | | | | |
| 17.4 | .19 | Poly(DADMAH) + NaOH | 14 | 8 | 10.7 + 53 | .075 + 1.3 | 61 | 5.54 | 6 | ~10 | 7 | 0 | <1 | <−97 |
| 17.4 | .19 | NaOH | 14 | 0 | 56 | 1.4 | 4.5 | 1.41 | −67 | | | | | |
| 17.4 | .19 | Poly(BAEHPAH) + $Na_2$Adipate + NaOH | 14 | 1.6 | 3.3 + 3.4 + 50 | .034 + .023 + 1.2 | 5.3 | 3.16 | −26 | | | | | |
| 17.4 | .19 | Poly(DADMAH) + $Al(OH)_3$ + NaOH | 14 | 8 | 0.8 + 4.5 + 55 | .006 + .172 + 1.4 | 13 | 3.9 | −9 | ~10 | 2 | −71 | <1 | <−97 |
| | | | | | N Base not Covalently Bonded to Polymer | | | | | | | | | |
| 17.4 | .19 | Poly(Choline Acrylate) + NaOH | 14 | 2 | 5.4 + 55 | .031 + 1.4 | 52 | 2.01 | −53 | | | | | |
| 17.4 | .19 | Poly(Na Tannate: Choline Acrylate 2.6:1) + NaOH | 14 | 6.3 | 5.7 + 55 | .016 + 1.4 | 7.3 | 1.86 | −57 | | | | | |
| 17.4 | .19 | Poly(NA Tannate: Choline Acrylate 1.5:1) + NaOH | 14 | 5.6 | 5.6 + 55 | .022 + 1.4 | 9.8 | 1.33 | −69 | | | | | |
| | | | | | 2-Stage Desalter Simulation | | | | | | | | | |
| 1.1 | 0.1 | none | | | 0 | 0 | 30 | 4.29 | 0 | 5 | 1 | −86 | | |
| 0 | 0 | Fresh washing of above des. crude | | | 0 | 0 | | 3.25 | 0 | 5 | 1 | −86 | 28 | 0 |
| 11 | .12 | Poly(DADMAH) + NaOH | 14 | 8 | 8.6 + 54 | .060 + 1.3 | 54 | 4.25 | 0 | 10 | 7 | 0 | | |
| 0 | 0 | Fresh washing of above des. crude | | | 0 | 0 | | 4.69 | 44 | 9.5 | 7 | 0 | <1 | <−97 |

These results confirm the efficacy of alkaline, hydrophilic, polymeric amines and ammonium hydroxides and alkaline, demonstrate that the carryover of (catalyst poisoning) monovalent, alkali metal adducts into the atmospheric tower resid can be lowered by increasing the ratio of di- or multivalent metallic bases to polymeric, organic and organometallic bases in the combined base treatment. The results show that MPEHS combined with alkali metal hydroxide forms an effective non-emulsifying, HCl precursor removal reagent.

The most efficacious reagents were the high molecular weight PQAH's. These compounds were made by adding an aqueous solution of poly(diallyldimethylammonium) chloride (DADMAC) of dp 1250 or the reaction product of about equal molar amounts of 3-chloromethyl-1,2-oxirane (epichlorohydrin or EPI), and an amine such as N,N-dimethyl-1,3-propanediamine (dimethylamino propylamine or DMAPA) and/or dimethylamine (DMA) of dp 400, or diethylene triamine adipamide (DETA-AdM) of dp 20, into a reaction flask, adding an excess molar amount of sodium hydroxide, and heating the solution to 260° F. from 20 minutes to equilibrate it to desalter conditions.

The last step would at least hydrolyze the EPI:DETA-AdM to EPI:DETA and $Na_2$Adipate, and might dequaternize some of the nitrogens as well. The NaCl produced by the chloride exchange was not removed from the solution since it was at relatively benign levels. It could be removed, however, by reverse osmosis, resin bed, solvent extraction, or the like, to reduce sodium levels.

The aluminum hydroxide [$Al(OH)_3$] was made from aluminum chlorohydrate [$Al_2Cl(OH)_5$] and an excess molar amount of sodium hydroxide (NaOH) using the same procedure as above. The results show that the conjunctive use of $Al(OH)_3$ with PAQH's, while not contributing much to the demulsification, does reduce the carryover of Na into the atmospheric resid. This carryover is not due to the entrainment of residual NaOH, since it does not wash out in a second, fresh water wash. Presumably, then, it is carryover of sodium soaps. The aluminum may convert these to the more oil soluble, trivalent, aluminum soaps.

Further studies were conducted on a crude oil of South American and Gulf of Mexico origin having the following salt characteristics:

| | Chloride Salts in Crude (ptb as NaCl) | | |
|---|---|---|---|
| | Hydrolyzable | Non-Hydrolyzable | Total |
| Extractable | 17.9 | 65.7 | 83.6 |
| Non-Extractable | 2.0 | 0.0 | 2.0 |
| Total | 19.9 | 65.7 | 85.6 |

Testing was performed as described above, except the desalter emulsion was made by mixing at 210° F. at 16 k rpm for 2 s, reflecting the local processing parameters. Results of this test are reported in Table VII.

TABLE VII

Crude Unit Simulation Results
South American and Gulf of Mexico Crude

| Treatment | | | | | | | | Demulsification | | | Overhead | |
|---|---|---|---|---|---|---|---|---|---|---|---|---|
| MPEHS Dose | | Alkaline Agent | | | | | Mean | | | | HCl/ Raw | |
| | | | Sol | C#/ | Dose | | Val./ | MWD | (MWD/ $MWD_o$) − 1 | Brine | Cl | (HCl/ $HCl_o$) − 1 |
| ppm | mN | Name | pH | N, O | ppm | mN | dp | % | Δ % | pH | % | Δ % |
| 4 | .05 | none | | | 0 | 0 | 30 | 4.38 | 0 | 7 | 25 | 0 |
| 31 | .34 | NaOH | 14 | 0 | 80 | 2.0 | 5.3 | 3.40 | −22 | 9.5 | 4 | −84 |
| 186 | 2.1 | NaOH | 14 | 0 | 160 | 4.0 | 11 | 2.18 | −50 | 10.0 | 1.5 | −94 |
| 248 | 2.8 | NaOH | 14 | 0 | 160 | 4.0 | 13 | 1.90 | −57 | 10.0 | <0.1 | −100 |
| 23 | .26 | NaOH + dimorpholinodi-ethyl ether | 14 | 2 | 80+ 25 | 2 + 0.6 | 4.6 | 1.52 | −65 | | | |
| 0 | 0 | NaOH + dimorpholinodi-ethyl ether | 14 | 2 | 80+ 200 | 2 + 4.9 | 4.6 | 0 | −100 | | | |
| 0 | 0 | dimorpholinodi-ethyl ether | 12 | 2 | 333 | 8.2 | 6.0 | 0.89 | −80 | | | |
| 0 | 0 | NaOH + dimorpholinodi-ethyl ether | 14 | 2 | 40+ 167 | 2 + 4.1 | 4.4 | 0 | −100 | | | |

On this crude it was possible to omit the nitrogenous bases entirely, provided sufficient caustic was used to attain the effluent brine pH of 9.5–10.0 and the amount and degree of polymerization on the multi-polyether headed surfactant was sufficient to raise the average metal valence/polymer dp of the treatment, as defined previously, above about 5.

A field trial was held at a Texas refinery where crude dimorpholinodiethyl ether (Huntsman Amine C-6) was fed to the interstage crude at 22 ppm. Desalter effluent pH increased from 5.5 to 6.3. Dehydration in the second stage improved, from a residual BS&W of 0.2% solids and 0.3% water to 0.2% solids and zero water. The overhead chlorides were reduced from 135 ppm (as Cl) to 115 ppm (−15%) immediately. They had fallen to 105 ppm (−22%) 24 hours later. The feed was stopped, and the overhead Cl level returned to 130 ppm immediately and 135 ppm 24 hours later. Residual Na in the atmospheric tower resid held constant at 5 ppm.

In a second trial, 4.8–11.5 ppm active (based on crude oil) poly (DADMAH) of dp 1250 was generated in the interstage brine by overbasing poly(DADMAC) with 40–100 ppm active (based on crude charge) NaOH. In addition, 6–11 ppm active of a MPEHS of the type described above was added to the raw crude charged to the unit. When 11.5 ppm poly(DADMAH) and 37 ppm excess NaOH was added, the pH of the effluent brine rose from 5.0 to 9.0 and the overhead Cl's fell from 130 ppm to 120 ppm. When an additional 30 ppm of NaOH was added, the pH of the effluent brine rose to 9.5 and the overhead Cl's fell to 65 ppm. When another 30 ppm of NaOH was added, the pH of the effluent brine rose to 10.0 and the overhead Cl's fell to 10 ppm, a 92% reduction. The poly(DADMAH) was then lowered to 4.8 ppm and the excess NaOH raised proportionately by 2 ppm in stages without loss of overhead Cl or demulsification control. Below 4.8 ppm poly (DADMAH), the emulsion layer grew, threatening to carry Cl's over and oil under. The treatment was maintained for 10 days to ensure its long-term viability. When the treatment was terminated, the overhead Cl's returned to 130 ppm.

The pH of the interstage brine prior to the addition of chemical treatment did not rise about 9.0. This allowed waste phenols in the fresh wash water to remain in their acid form to be extracted into the interstage crude in the second stage, an environmentally critical function of the desalter. This indicates that significant amounts of free caustic were not being carried over. In fact, the efficiency of the removal of alkali metals (both Na and K were present) in the desalter arguably improved during the trial: prior to the trial, Na+K levels ranged from 1.0 to 4.0 ppm (1.5 average) in the raw crude and 0.3 to 3.3 ppm (1.4 average) in the resid. During the trial, they ranged from 1.0 to 9.7 ppm (5.3 average) in the raw crude and 2.5 to 3.0 ppm (2.7 average) in the resid.

The efficiency of the removal of total acids (as measured by TAN) in the desalter fell during the trial: prior to the trial, TAN's ranged from 0.26 to 0.6 (average 0.4) in the raw crude and 0.20 to 0.38 (average 0.26) in the desalted crude; during the trial, they ranged from 0.34 to 0.36 (average 0.35) in the raw crude and 0.30 to 0.31 (average 0.30) in the desalted crude. Nevertheless, overhead corrosion, as indicated by the iron levels in the resid, was almost completely eliminated. Fe in the resid fell from 7–17 ppm (average 12.3 ppm) before the trial to 2.0 ppm (the concentration corrected level in the raw crude) during the trial. The treatment was thus highly selective in removing only that small fraction of acids most responsible for overhead corrosion (primarily HCl but probably including any sulfoxy acids and the stronger organic acids). The elimination of iron in the resid has a significant value in its own right, since it serves as a downstream foulant of exchangers and filters and as a catalyst of oxidatively induced organic fouling. As such, this treatment is expected to reduce fouling.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus defined the invention, what I claim is:

1. A method for reducing corrosion in an overhead of a crude unit distillation tower distilling crude oil comprising:

washing the crude oil with water which contains dissolved therein at least one of:

(a) nitrogenous base, said nitrogenous base having an aqueous or alcoholic solution or dispersion pH of at least 11, and comprising at least one of:

polyetheramines, polyamines, polyimines, polypyridines, and poly(quaternary ammonium) bases having about 1 to 10 carbon atoms per nitrogen or oxygen and degree of polymerization of about 6 to about 60,000, and hydroxides, carbonates and silicates of alkyl or alkylaryl quaternary amines of 12 to 72 carbon atoms per quaternary nitrogen;

(b) di- or multivalent metallic base; and (c) combination of multi-polyether-headed surfactant and a monovalent metallic base;

said dissolved bases and combination being effective for reducing concentration of overhead HCl producing species.

2. The method according to claim 1, wherein said water contains dissolved therein said nitrogenous base.

3. The method according to claim 2, wherein said nitrogenous base comprises at least one of polyetheramines, polyamines, polyimines, polypyridines, and poly(quaternary ammonium) base having about 1 to 10 carbon atoms per nitrogen or oxygen and degree of polymerization of about 6 to about 60,000.

4. The method according to claim 3, wherein said nitrogenous base comprises at least one of polyetheramines, polyamines, and polyimines.

5. The method according to claim 4, wherein said nitrogenous base comprises at least one of morpholine still bottoms, poly(oxyethylene)diamines of dp 13, and polyethyleneimine of dp 28.

6. The method according to claim 2, wherein said nitrogenous base comprises morpholine still bottoms, and said morpholine still bottoms contain dimorpholinodiethyl ether.

7. The method according to claim 3, wherein said nitrogenous base comprises poly(quaternary ammonium) base.

8. The method according to claim 7, wherein said poly (quaternary ammonium) base comprises at least one of silicates, carbonates and hydroxides of alkyl or alkylaryl quaternary amines.

9. The method according to claim 8, wherein said poly (quaternary ammonium) base comprises at least one of poly(diallyldimethylammonium hydroxide), poly(N,N-dimethyl, 2-hydroxypropyleneammonium hydroxide) and poly[N,N-dimethyl, 3-(2-hydroxypropylene ammonium) propylammonium hydroxide].

10. The method according to claim 2, wherein said nitrogenous base comprises at least one of hydroxides, carbonates and silicates of alkyl or alkylaryl quaternary amines of 12 to 72 carbon atoms per quaternary nitrogen.

11. The method according to claim 10, wherein said alkyl or alkylaryl quaternary amine base comprises at least one of tributylmethylammonium hydroxide and dimethyltallow-(3-trimethylammoniumpropylene) ammonium carbonate.

12. The method according to claim 2, wherein said nitrogenous base is dissolved in said water washing the crude oil in an amount ranging from about 4,000 to about 12,000 parts per million parts water, or about 200 to about 600 parts per million parts crude oil.

13. The method according to claim 1, wherein said water contains dissolved therein said di- or multivalent metallic base.

14. The method according to claim 13, wherein said di- or multivalent metallic base has an aqueous solution pH of at least 11.

15. The method according to claim 14, wherein said di- or multivalent metallic base comprises at least one of hydroxides, carbonates and silicates of alkaline earth metals, and hydroxides of amphoteric cations $Zn^{+2}$, $Al^{+3}$, and $Zr^{+4}$.

16. The method according to claim 15, wherein said di- or multivalent metallic base is $Ca(OH)_2$ or $Al(OH)_3$.

17. The method according to claim 13, wherein said di- or multivalent metallic base is dissolved in said water washing the crude oil in an amount ranging from about 2,000 to about 12,000 parts per million parts water, or about 10 to about 600 parts per million parts crude oil.

18. The method according to claim 1, wherein said water contains dissolved therein said combination of multi-polyether-headed surfactant and a monovalent metallic base.

19. The method according to claim 18, wherein said monovalent metallic base has an aqueous solution pH of at least 13.

20. The method according to claim 19, wherein said monovalent metallic base comprises at least one of hydroxides, carbonates and silicates of lithium, sodium, potassium, rubidium, cesium, and francium.

21. The method according to claim 18, wherein said multi-polyether-headed surfactant comprises at least one of hydrophobes of $C_3$ to $C_{18}$ alkyl, alkylaryl, or alkylether diols or polyols; $C_3$ to $C_{18}$ alkyl or alkylaryl 1° or 2° amines; and $C_3$ to $C_{18}$ alkylphenolic resins having a degree of polymerization greater than or equal to 2; adducted with two or more hydrophilic heads per hydrophobe comprising chains of poly($C_2$ to $C_3$ alkylene oxide) of dp 3 to 30.

22. The method according to claim 21, wherein the hydrophobes or hydrophiles of said multi-polyether surfactants are further crosslinked with aldehydes, epoxides or isocyanates.

23. The method according to claim 21, wherein said multi-polyether-headed surfactants comprise at least one of branched nonylphenol-formaldehyde resins of dp 4 to 8 adducted with 4 to 8 chains of poly(ethylene oxide) of dp 4 to 7, blended with polypropylether diols of dp 30 to 50 adducted with 2 chains of poly(ethylene oxide) of dp 13 to 22.

24. The method according to claim 18, wherein the ratio of multi-polyether-headed surfactant to monovalent metallic base is sufficient for the mole fraction of alkaline or ether moieties on each molecule in the treatment times the number of alkaline or ether moieties on each molecule to be at least about 2.

25. The method according to claim 24, wherein the combination of multi-polyether surfactant and monovalent metallic base is dissolved in said water washing the crude oil in an amount ranging from about 1,000 to about 4,000 parts per million parts water, or about 50 to about 200 parts per million parts crude oil.

26. The method according to claim 1, wherein mixtures of at least two of said nitrogenous base, said di- or multivalent metallic base and said combination are added to said water.

27. The method according to claim 1, wherein the amount of base dissolved in said water washing the crude oil is an amount sufficient to raise the pH of the effluent brine resulting from said washing to at least 9.

28. The method according to claim 2, wherein the amount of base dissolved in said water washing the crude oil is an amount sufficient to raise the pH of the effluent brine resulting from said washing to at least 9.

29. The method according to claim 13, wherein the amount of base dissolved in said water washing the crude oil is an amount sufficient to raise the pH of the effluent brine resulting from said washing to at least 9.

30. The method according to claim 18, wherein the amount of base dissolved in said water washing the crude oil is an amount sufficient to raise the pH of the effluent brine resulting from said washing to at least 9.

31. The method according to claim 1, wherein said water washing the crude oil is interstage effluent brine from the second stage of a two-stage, serial, counterflow desalter extraction unit.

* * * * *